US008322831B2

(12) United States Patent
Bachar et al.

(10) Patent No.: US 8,322,831 B2
(45) Date of Patent: Dec. 4, 2012

(54) AUTOMATIC CLEANING IN A LIQUID INK PRINTING SYSTEM

(75) Inventors: Eyal Bachar, Modi'in (IL); Albert Teishev, Rishon le-zion (IL); Kobi Shkuri, Tel-Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 782 days.

(21) Appl. No.: 12/397,865

(22) Filed: Mar. 4, 2009

(65) Prior Publication Data

US 2010/0225715 A1 Sep. 9, 2010

(51) Int. Cl.
*B41J 2/175* (2006.01)

(52) U.S. Cl. ..... 347/85; 347/84; 347/93; 347/89

(58) Field of Classification Search ..... 347/84, 347/85, 86, 93, 34, 33, 32, 28, 89
See application file for complete search history.

(56) References Cited

U.S. PATENT DOCUMENTS

| | | | | |
|---|---|---|---|---|
| 3,825,022 | A | 7/1974 | Metz | |
| 4,175,489 | A * | 11/1979 | Gattus | 101/366 |
| 4,534,291 | A * | 8/1985 | Sabota et al. | 101/483 |
| 5,352,298 | A | 10/1994 | Moulder | |
| 5,786,829 | A * | 7/1998 | Pasciak et al. | 347/28 |
| 6,183,058 | B1 * | 2/2001 | Sharma et al. | 347/28 |
| 6,213,134 | B1 | 4/2001 | Pike | |
| 6,345,631 | B1 | 2/2002 | Brunson | |
| 6,663,220 | B2 * | 12/2003 | Suzuki et al. | 347/85 |
| 6,868,857 | B2 | 3/2005 | McCasker | |
| 7,008,037 | B2 * | 3/2006 | Caren et al. | 347/28 |
| 7,100,541 | B2 | 9/2006 | Frasure et al. | |
| 2005/0103217 | A1 * | 5/2005 | Biasini | 101/425 |
| 2005/0264619 | A1 * | 12/2005 | Walton et al. | 347/84 |
| 2005/0264620 | A1 * | 12/2005 | Kuester et al. | 347/84 |

OTHER PUBLICATIONS

"Technical Manual GP-Tinter—SA-SB Series of tinters + Manual & Automatic colourchange systems"; Manual; GP-Tinter AS, P.O. Box 54/ Hvamsvingen 11, N-2026 Skjetten, Norway; http://www.gp-stratum.com/fileadmin/Manuals/SB_Manual.pdf.

* cited by examiner

*Primary Examiner* — Manish S Shah

(57) ABSTRACT

A system for automatic cleaning in a liquid ink printing system includes an ink tank, a pump which is configured pump a carrier liquid from the ink tank as a pressurized carrier liquid flow. A filter is configured to remove particulates from the pressurized carrier liquid flow to produce a filtered carrier liquid flow. A sprayer is configured to receive the filtered carrier liquid flow and spray the filtered carrier liquid flow into an interior of the ink tank. The pump recirculates the filtered carrier liquid flow through the filter and the sprayer. A method for automatic cleaning in a printing system is also included.

14 Claims, 10 Drawing Sheets

AUTOMATIC CLEANING IN A LIQUID INK PRINTING SYSTEM

BACKGROUND

Printing systems may use liquid inks which are stored in ink tanks. These liquid inks are pumped from the ink tanks through the printing system during the printing process. In some cases it may be desirable to change the color or type of inks used by the printing system. For example, a new print run may require the replacement of a particular ink with a specialized spot color ink to achieve a desired metallic, fluorescent, or tint effect. Ideally, the entire printing system would be cleaned to remove residuals of the first ink to avoid cross contamination of the replacement ink. The process of changing inks may be a manual and lengthy process which requires the operator to remove the ink tank, drain the current ink from the ink tank, clean the ink tank, purge the supply lines and printing apparatus to remove residuals of the first ink from the system, and then refill the ink tank with the replacement ink. To facilitate the flexibility and ease of changing inks within a printing system, it is desirable to automate the ink color change process.

Additionally, it may be desirable to periodically clean the printing system even if the colors of the ink remain the same. These maintenance cleanings can improve the printing performance of the system, extend the lifetime of various components, and improve the efficiency of the printing system. Manual maintenance cleanings can take a significant amount of time and training to perform. During this time period, the printing system is typically idle. By automating these maintenance cleanings, the cleanings could be performed more quickly, accurately, and with less training.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
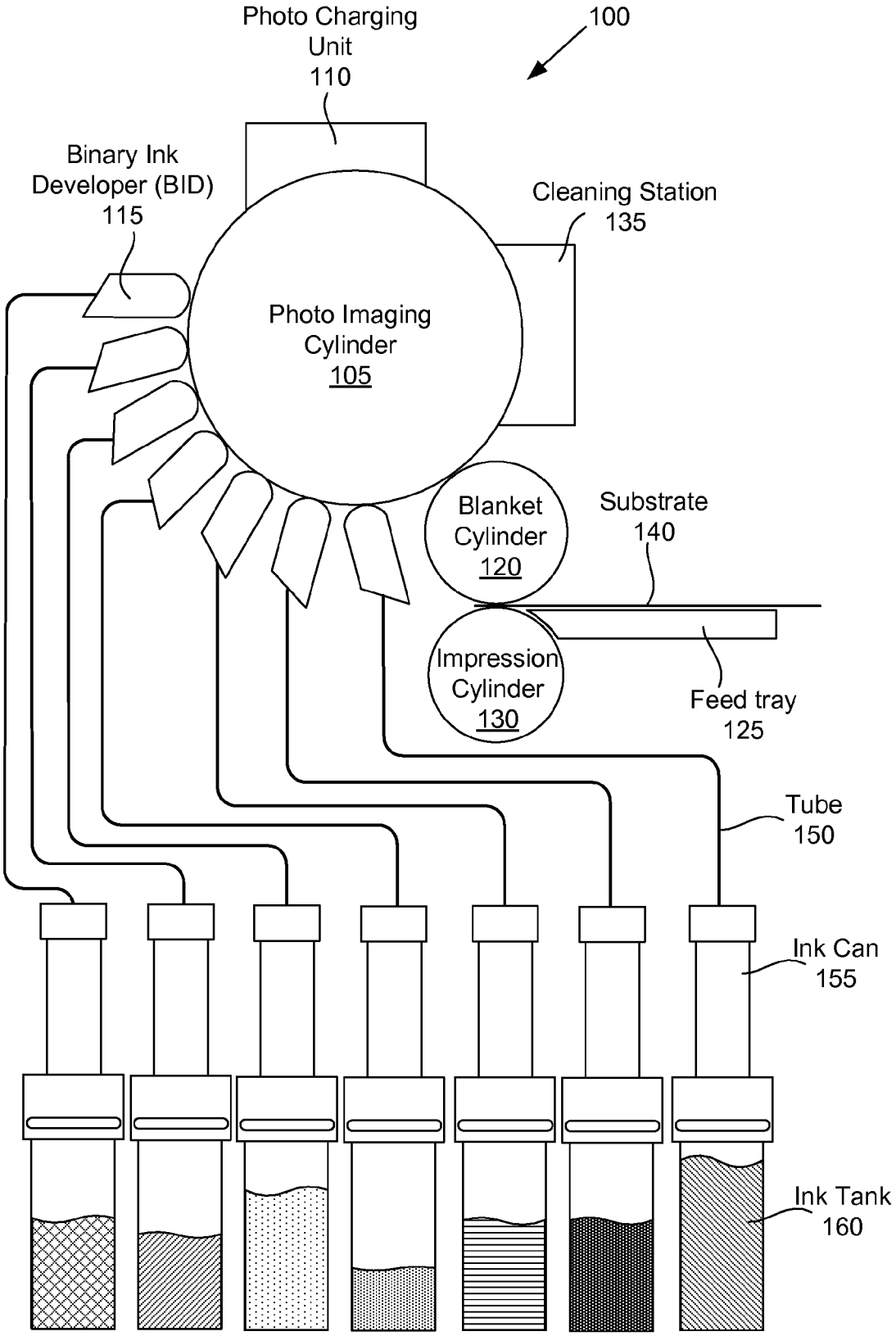
FIG. 1 is a diagram of one illustrative embodiment of an illustrative digital printing system, according to one embodiment of principles described herein.

Digital printing refers to a printing process in which a printed image is created directly from digital data. In contrast to typical printing processes, the words, pages, text and images are created with electronic layout and/or desktop publishing programs and printed by the digital printer without any intermediate steps. In a non-digital printing process, these intermediate steps restrict the flexibility and speed at which new printing jobs can be started. For example, these intermediate steps may include film processing, imagesetters, plates, photochemicals, plate mounting, and registration. Because digital printers do not require any manual configuration between print jobs, digital printers are capable of printing different images on each sheet of substrate and rapid reconfiguration. This versatility makes digital printers well suited to shorter print runs and specialized printing tasks.

However, in some cases it may be desirable to change the color or type of a source ink used by the printer. For example, a new print run may require the replacement of a particular ink with a specialized spot color ink to achieve a desired metallic, fluorescent, or tint effect. The process of changing inks is primarily a manual process which requires the operator to remove the ink tank, drain the current ink from the tank, clean the tank, purge the supply lines and printing apparatus to remove ink from the system, and then refill the tank with the new ink. To facilitate the flexibility and ease of changing inks within a printing system, it is desirable to automate the ink color change process.

Additionally, it may be desirable to periodically clean the printing system even if the colors of the ink remain the same. These maintenance cleanings can improve the printing performance of the system, extend the lifetime of various components, and improve the efficiency of the printing system. Manual maintenance cleanings can take a significant amount of time and training to perform. During this time period, the printing system is typically idle. By automating these maintenance cleanings, the cleanings could be performed more quickly, accurately, and with less training.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The term "electrostatically printing" refers to a process of printing whereby a colorant or other material is arranged into a pattern or a layer by an electric field. This can occur by passing a colorant or other material through an electric field onto an electrostatic surface. One example of electrostatic printing is the LEP process.

The term "liquid electro printing" (LEP) refers to a process of printing in which ink is printed through an electric field onto a surface to form an electrostatic pattern. In most LEP processes, this pattern is then transferred to at least one intermediate surface, and then to a substrate. The term "liquid electro printer" refers to a printer capable of LEP.

FIG. 1 is a diagram of one illustrative embodiment of a digital LEP system (100). The desired image is initially formed on the photo imaging cylinder (105), transferred to the blanket cylinder (120), and then transferred to the substrate (140). The desired image is communicated to the printing system (100) in digital form. The desired image may be text, pictures, black/white images, partial color, full color images, or any combination of text and images.

According to one illustrative embodiment, an image is formed on the photo imaging cylinder (105) by rotating a clean, bare segment of the photo imaging cylinder (105) under the photo charging unit (110). A uniform static charge is deposited on the photo imaging cylinder (105) by a corona wire. As the photo imaging cylinder (105) continues to rotate, it passes through the laser imaging portion of the photo charging unit (110). A number of diode lasers dissipate the static charges in portions of the image area to leave an invisible electrostatic charge pattern that replicates the image to be printed.

A number of ink tanks (160) contain inks which are supplied to corresponding Binary Ink Developer (BID) units (115). There is one BID unit (115) for each ink color. According to one illustrative embodiment, the ink is supplied in concentrated form in an ink can (155). Concentrated ink paste is dispensed from the ink can (155) into the ink tank (160). In the ink tank (160), the concentrated paste is mixed with imaging oil to form the ink. The characteristics of the ink in the ink tank (160) are carefully controlled to maintain the printing quality of the system. For example, the ink tank (160) may contain a number of sensors which detect the temperature, density, amount, and flow rate of the ink. If any of these parameters drift out of a set range, appropriate correction is taken. For example, if the temperature of the ink is too high, coolant may be circulated through a heat exchanger in the ink tank to cool the ink. If the density of the ink is too low, more ink solids may be added from the ink can (155). A pump inside the ink tank (160) provides the associated BID (115) with the desired amount of ink through a tube (150). The excess ink from the BID is returned to the ink tank (160) through a separate return line. This excess ink is reconditioned in the ink tank (160) and recirculated to the BID (115).

During printing, the appropriate BID unit is engaged with the photo imaging cylinder (105). The engaged BID unit presents an inking roller which has a uniform film of ink to the photo imaging cylinder (105). The ink contains electrically charged pigment particles which are attracted to the opposing electrical fields on the image areas of the photo imaging cylinder (105). The ink is repelled from the non-image areas. The photo imaging cylinder (105) now has a single color ink image on its surface. According to illustrative embodiment, the photo imaging cylinder (105) continues to rotate and transfers the ink image to a blanket cylinder (120). The process of transferring the ink image from its origin on the photo imaging cylinder is called "offset printing." The offset printing method has several advantages. First, the offset process protects the photo imaging cylinder from wear which would occur if the substrate was to directly contact the photo imaging cylinder. Second, the blanket cylinder (120) is covered with a renewable rubber blanket. This rubber blanket compensates for unevenness of the substrate surface and deposits ink uniformly into the bottom of any depressions or grain. Consequently, the illustrative digital LEP system can print on a very wide range of substrate surfaces, textures, and thicknesses.

The substrate (140) enters the printing system (100) from the right, passes over a feed tray (125), and is wrapped onto the impression cylinder (130). As the substrate (140) contacts the blanket cylinder (120), the single color ink image is transferred to the substrate (140).

The photo imaging cylinder (105) continues to rotate and brings the portion of the cylinder surface which previously held the ink image into a cleaning station (135). The cleaning station (135) serves multiple purposes, including cleaning any stray particulates or fluids from the photo imaging cylinder (105) and cooling the outer surface of the photo imaging cylinder (105). The creation, transfer, and cleaning of the photo imaging cylinder (105) is a continuous process, with hundreds of images being created and transferred per minute.

To form a single color image (such as a black and white image), one pass of the substrate between the impression cylinder (130) and blanket cylinder (120) completes transfer of the image. For a multiple color image, the substrate is retained on the impression cylinder and makes multiple contacts with the blanket cylinder (120). At each contact, an additional color is placed on the substrate. For example, to generate a four color image, the photo charging unit (110) forms a second pattern on the photo imaging cylinder (105) which receives the second ink color from a second binary ink developer. As described above, this second ink pattern is transferred to the blanket cylinder (120) and impressed onto the substrate as it continues to rotate with the impression cylinder (130). This continues until the desired image is formed on the substrate. Following the complete formation of the desired image on the substrate (140), the substrate (140) can exit the machine or be duplexed to create second image on the opposite surface of the substrate (140).

As shown in FIG. 1, there may be a number of ink tanks and associated BIDs (115). A widely used offset printing technique is to use four process colors: Cyan, Magenta, Yellow, and Key (black). Some more advance processes use six process colors to compensate for limitations in the four color method. Additionally, spot colors may be desirable to achieve the desired visual or textual effect. For example, spot colors may produce metallic, fluorescent, spot varnish, coating, or other effects. Custom spot colors may be mixed on site or ordered. These custom spot colors may be more efficient in generating the desired color and/or provide specialized visual effects on the printed substrate. For example, spot colors are particularly effective in security printing, such as money, passports, bonds and other printed documents.

The advantages of the illustrative digital offset LEP system described above include consistent dot gain, optical densities, and colors. Because the printing system is digital, the operator can change the image being printed at any time and without any reconfiguration. Further, the printing system produces uniform image gloss, a broad range of ink colors, compatibility with a wide variety of substrate types, and instantaneous image drying.

Figure 2:
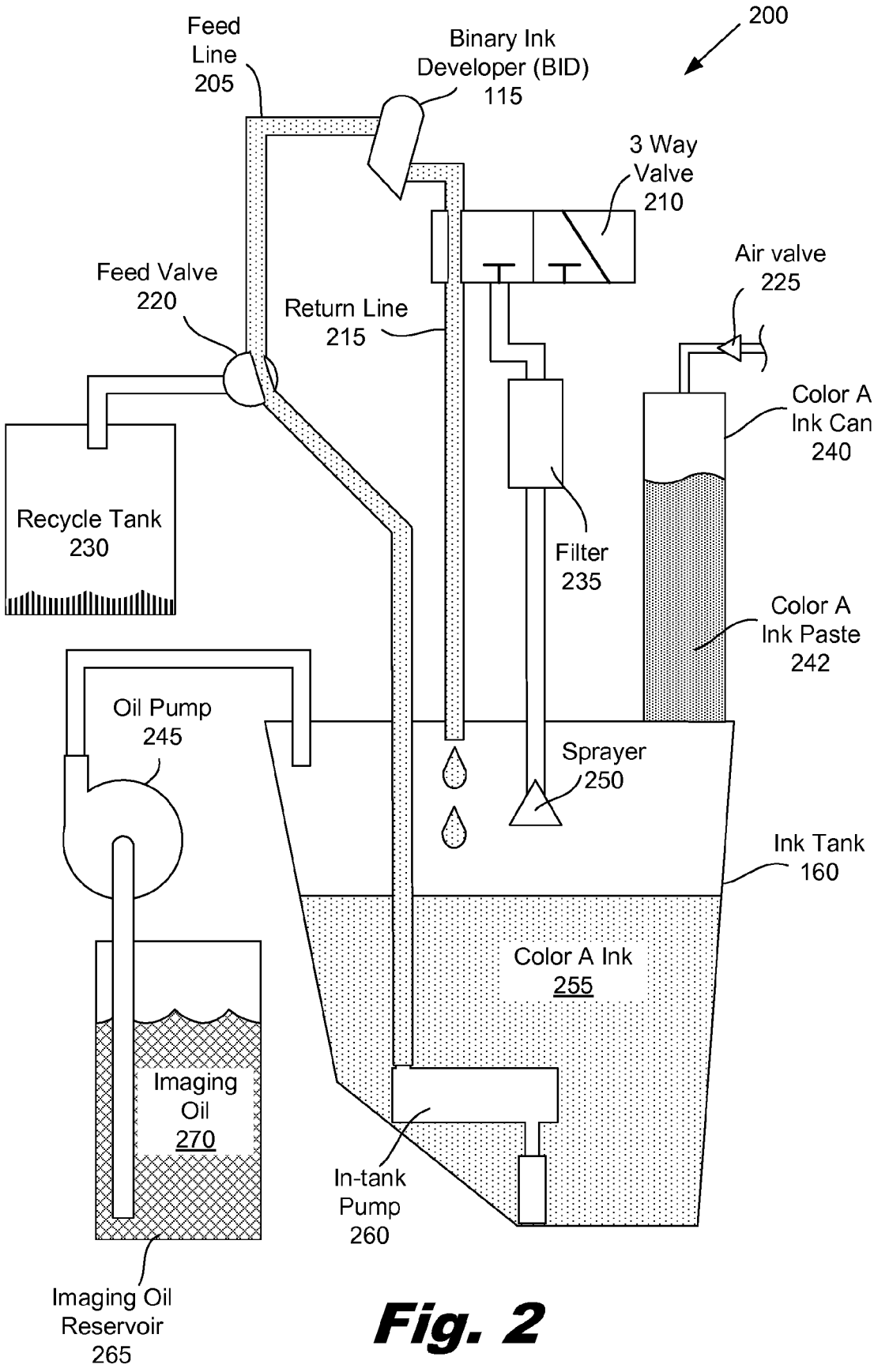
FIG. 2 is a diagram of an illustrative ink delivery system, according to one embodiment of principles described herein.

FIG. 2 is a diagram of an illustrative ink delivery system (200). As discussed above, a color A ink paste (242) may be contained in a color A ink can (240). The color A ink paste (242) may be forced out of the ink can using pressurized air. The introduction of the pressurized air into the ink can (240) is controlled by an air valve (225). According to one illustrative embodiment, the air valves (225), as well as other valves in the ink delivery system, are computer controlled and allow automatic adjustment of the system configuration.

The color A ink paste (242) enters the ink tank (160), where it is mixed with imaging oil (270). The imaging oil (270) serves as a fluid carrier for the ink particles and is supplied as needed from an imaging oil reservoir (265) by an oil pump (245).

As discussed above, the ink tank (160) contains a number of sensors and conditioning devices. For example, the ink tank (160) may contain a temperature sensor, heating coil, and a cooling coil. To be effective, many of these sensors and conditioning devices must be in direct contact with the ink in the ink tank (160). Consequently, the ink coats the surfaces of the sensors and conditioning devices.

During a printing run, the in-tank pump (260) provides conditioned color A ink (255) to the BID (115) at a pressure and flow rate within acceptable ranges through a feed line (205). The feed line passes through a feed valve (220) and connects to the BID (115). The BID (115) presents a uniform film of color A ink to the photo imaging cylinder (105, FIG. 1). A portion of the ink solids within the color A ink are transferred from BID (115) to the photoimaging cylinder (105, FIG. 1). The majority of imaging oil (270) and a portion of the ink solids are returned to the ink tank (160) through a return line (215) for reconditioning.

A number of additional components can be present within the system to facilitate the automatic cleaning within the system. These components include the feed valve (220) which can be used to divert the output of the in-tank pump (260) into a recycle tank (230). A three way valve (210) can be used to divert the returning ink flow through a filter (235) and out of a sprayer (250).

FIGS. 3-8 show illustrative steps in performing an automatic cleaning within the printing system. For purposes of illustration, components which are not directly involved in the step illustrated in a given figure are shown as dotted outlines.

Figure 3:
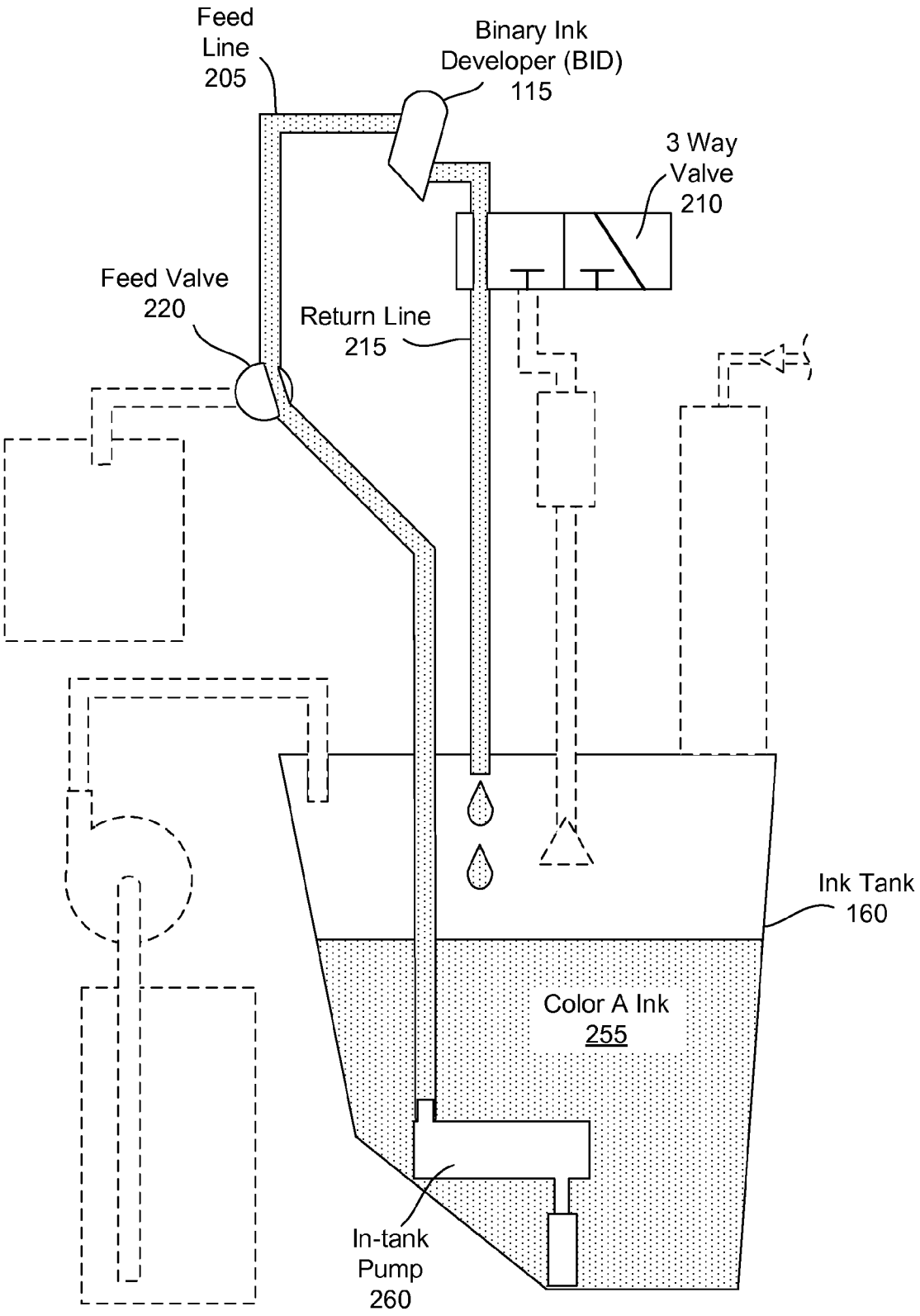
FIG. 3 is a diagram of an illustrative ink delivery system supplying ink to a binary ink developer, according to one embodiment of principles described herein.

FIG. 3 shows the normal operation of the printing device during a printing run. As discussed above, the in-tank pump (260) supplied color A ink (255) through a feed line (205) and feed valve (220) to the BID (115). The return flow of ink passes through the return line (215) and 3-way valve (210) to the ink tank (160). The operator of the printing system may decide, for any of a variety of reasons, that that the color A ink (255) should be replaced with color B ink or that the system should receive a maintenance cleaning.

Figure 4:
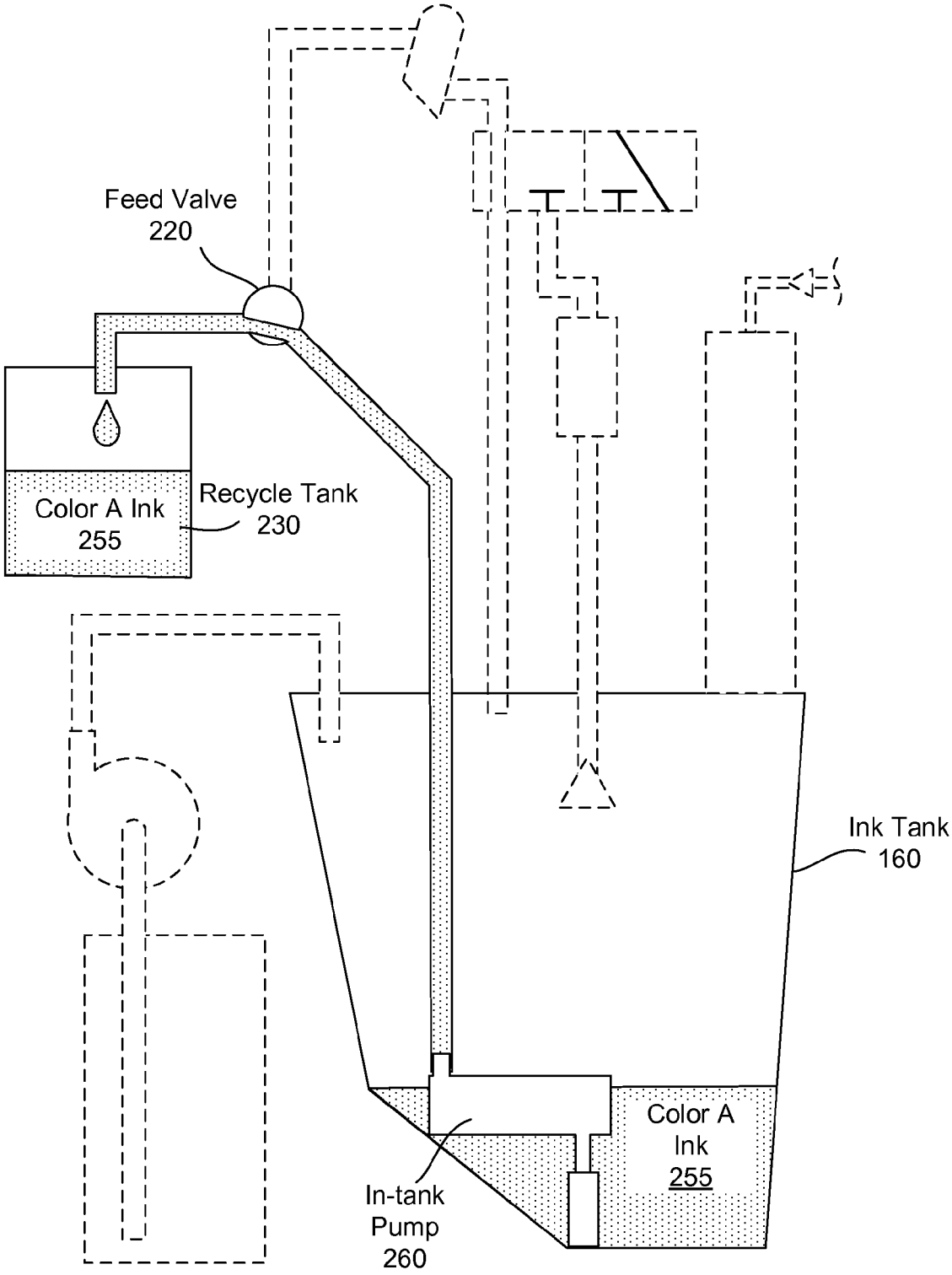
FIG. 4 is a diagram of an illustrative ink delivery system emptying an ink tank, according to one embodiment of principles described herein.

FIG. 4 shows a first step in an illustrative automatic cleaning process in which the contents of the ink tank (160) are emptied into the recycle tank (230). The feed valve (220) is rotated to direct the color A ink (255) out of the ink tank (160) and into the recycle tank (230). The feed valve (220) is illustrated as a rotary valve but may be any one of a variety of switching valves. The recycle tank (230) may have a variety of configurations. According to one illustrative embodiment, the recycle tank (230) may be dedicated to a particular ink tank. The color A ink (255) may be saved and reused when color A ink (255) is included in the printing ink palette. In an alternative embodiment, the recycle tank (230) is a waste tank which is connected to all of the ink tanks in the printing system. When ink colors are changed within any of the ink tanks in the system, the ink tanks (160) are emptied into the waste tank. Consequently, the ink colors are mixed and the inks cannot be directly reused. This waste tank may be periodically emptied to remove the accumulated fluids and ink solids. Additionally or alternatively, the recycle tank or waste tank may be connected to a disposal drain. The recycle tank or waste tank may serve as a filter to trap materials or fluids which are not desirable to be disposed of through the disposal drain. In another embodiment, the unwanted color A ink may be pumped or drained directly into the disposal drain.

The in-tank pump (260) continues to operate until all the accessible color A ink (255) is pumped into the recycle tank (230). However, color A ink (255) is still present throughout the ink tank (160), on surfaces of components within the ink tank (160), within the in-tank pump (260), and in the feed line (205, FIG. 3), feed valve (220, FIG. 3), BID (115, FIG. 3), and return line (215, FIG. 3).

Figure 5:
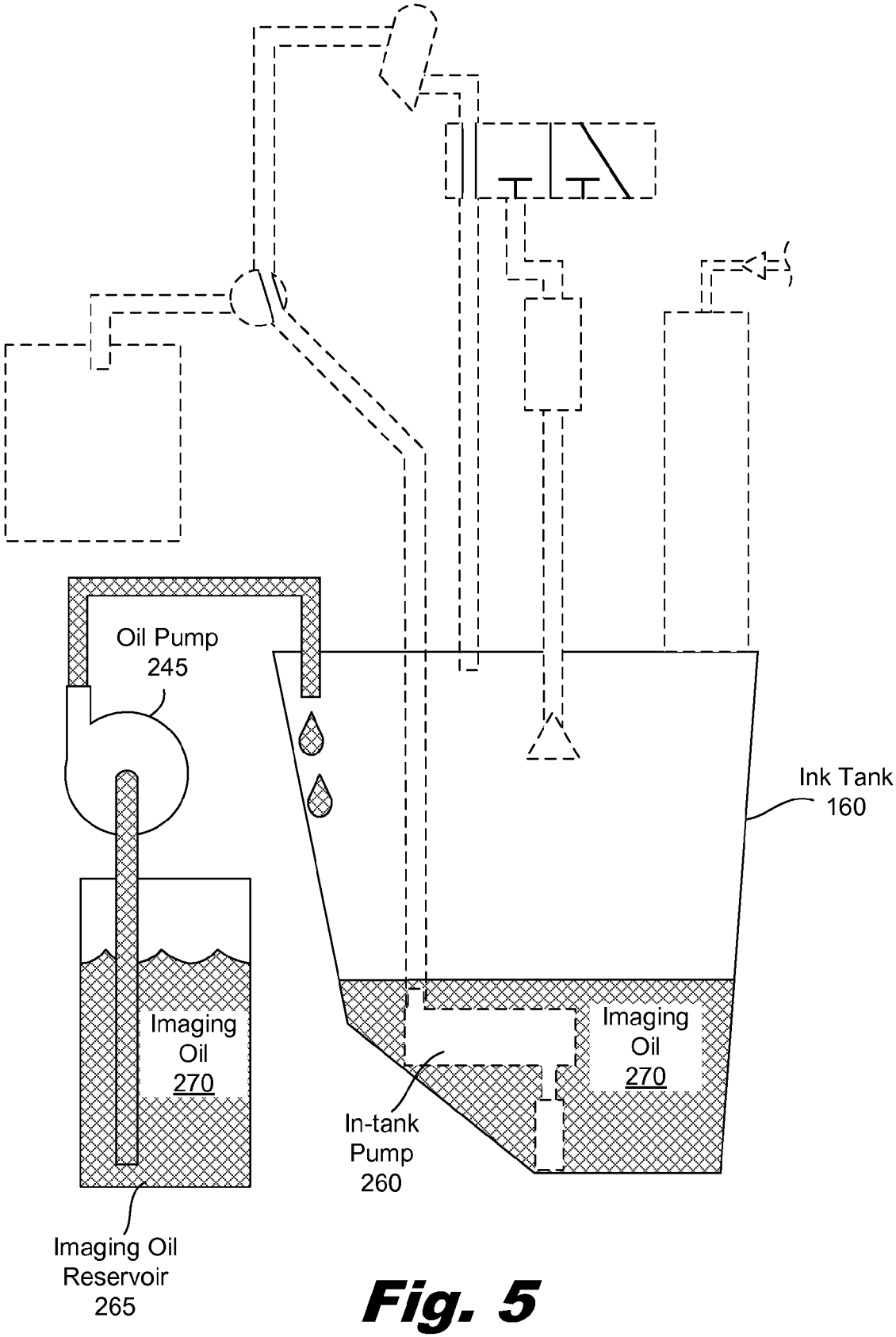
FIG. 5 is a diagram of an illustrative ink delivery system supplying ink introducing carrier liquid into an ink tank, according to one embodiment of principles described herein.

FIG. 5 shows a second step in an illustrative automatic cleaning process in which clean imaging oil (270) is pumped from the imaging oil reservoir (265) into the ink tank (160) by the oil pump (245). This clean imaging oil (270) can then be use as a carrier liquid which washes the color A ink from surfaces and removes color A ink pigment sludge from the printing system.

According to one illustrative embodiment, a large volume of clean imaging oil (270) is not required for the washing process. For example, if the capacity of the ink tank (160) is four liters, only about one liter of clean imaging oil (270) is pumped into the ink tank (160).

Figure 6:
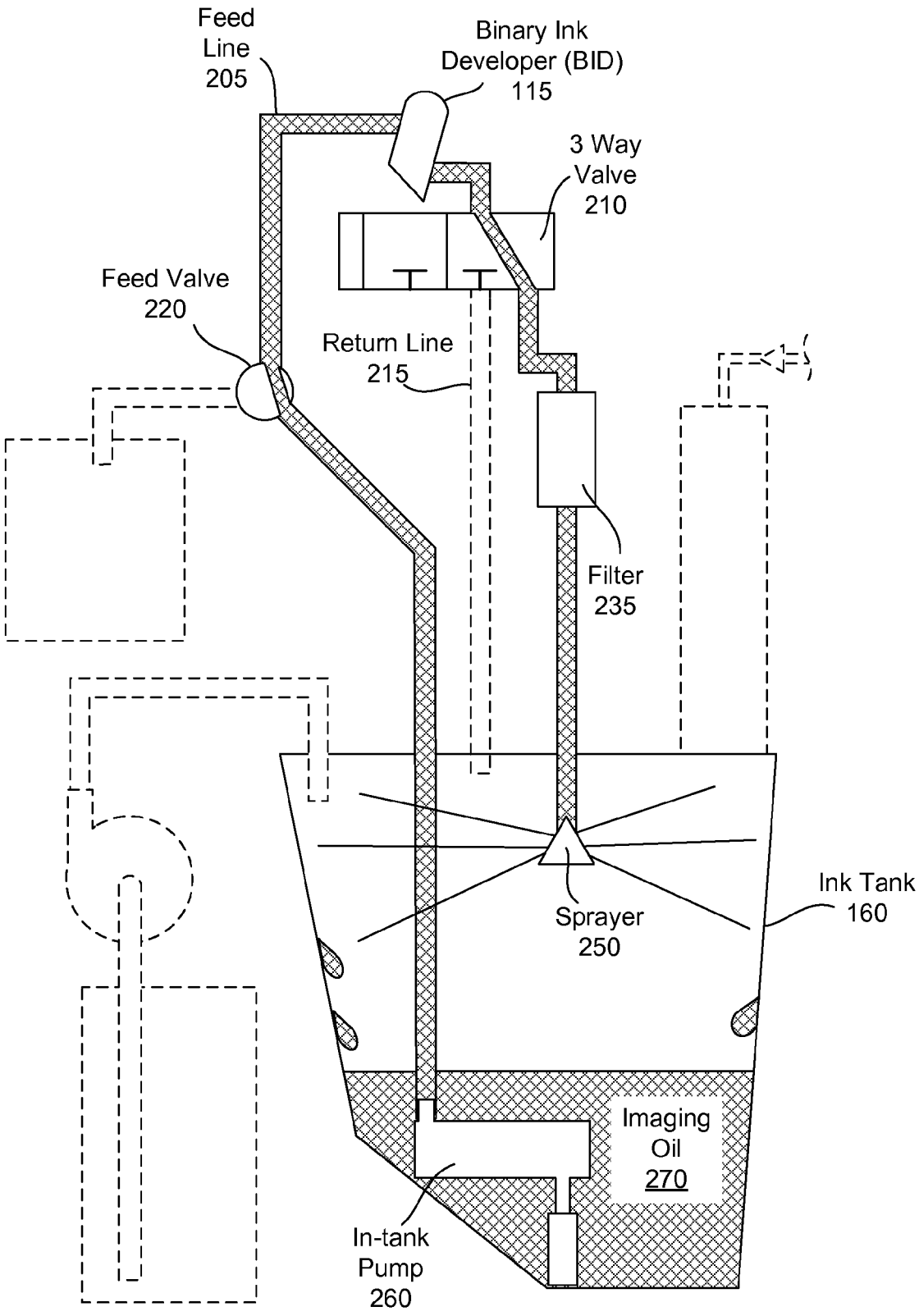
FIG. 6 is a diagram of an illustrative ink delivery system pumping carrier liquid through the printing system during an automatic cleaning cycle, according to one embodiment of principles described herein.

FIG. 6 shows a third step in an illustrative automatic cleaning process in which the imaging oil (270) is used to purge the ink supply system and wash the ink tank (160) interior. According to one illustrative embodiment, the in-tank pump (260) is activated to pump the imaging oil (270) into the feed line (205). The feed valve (220) is switched to direct the flow of imaging oil (270) to the BID (115). As the imaging oil (270) comes in contact with the interior of the ink tank (160) and is pumped through the in-tank pump (260) and feed line (205), the imaging oil (270) picks up color A ink particles. According to one illustrative embodiment, the mechanisms within the BID (115) are operated to allow the imaging oil (270) to circulate through the entire BID mechanism. The 3-way valve (210) is shifted to the left to direct the return flow of imaging oil through filter (235).

The filter (235) removes the color A ink particles from the return flow and allows the imaging oil (270) to pass into the ink tank (160) through a sprayer (250). The filter (235) may use a variety of mechanisms to separate undesirable particulates or fluids from the imaging oil (270). By way of example and not limitation, the filter (235) may use filter media with pore sizes which trap the majority of the particulates but allow the imaging oil to pass through. Filter media may be fibrous media, ceramic media, or a bed of granular material. The filter may require periodic replacement or cleaning to open pores blocked by particulates. Additionally or alternatively, the filter may include a permanent magnet which attracts ferrous particulates which may be generated during the operation of the equipment.

The sprayer (250) is configured to distribute imaging oil throughout the interior of the ink tank (160) to wash color A particulates off of the various surfaces. According to one illustrative embodiment, a single sprayer is configured to distribute imaging oil throughout the ink tank (160). For example, the sprayer (250) may have nozzles which direct the imaging oil in all directions within the ink tank. Additionally or alternatively, the sprayer (250) may move to further distribute the streams of imaging oil throughout the tank (160). In one illustrative embodiment, the sprayer has relatively few nozzles, but rotates about its axis to direct relatively high velocity streams of imaging oil throughout 360 degrees.

In some embodiments, multiple fixed sprayers may be used. For example, a first fixed sprayer may be located in one of the upper corners of the ink tank (160) and a second fixed sprayer may be located in a second upper corner of the ink tank (160). In this configuration, each object within the ink tank (160) may receive stream of imaging oil from two separate directions.

A variety of additional components may be incorporated into the system to achieve the desired purging and cleaning action. For example, an additional pump may be included between the filter (235) and the sprayer (250) to provide higher pressure washing action by the sprayer (250). An agitator may be included to circulate the imaging oil (270) within the bottom of the ink tank (160). A number of sensors may be included to monitor the cleaning process. For example, an optical sensor could be incorporated to monitor the amount of suspended solids in the imaging oil or to measure surface contamination.

The operation of the system as shown in FIG. 6 can continue until the desired level of removal of the color A ink has occurred. The duration of the cleaning cycle may be actively controlled or may run for a fixed amount of time. However, in the configuration illustrated in FIG. 6, there are several portions of the system which have not been purged, namely, the through portion of the 3 way valve (210) and the return line 215.

Figure 7:
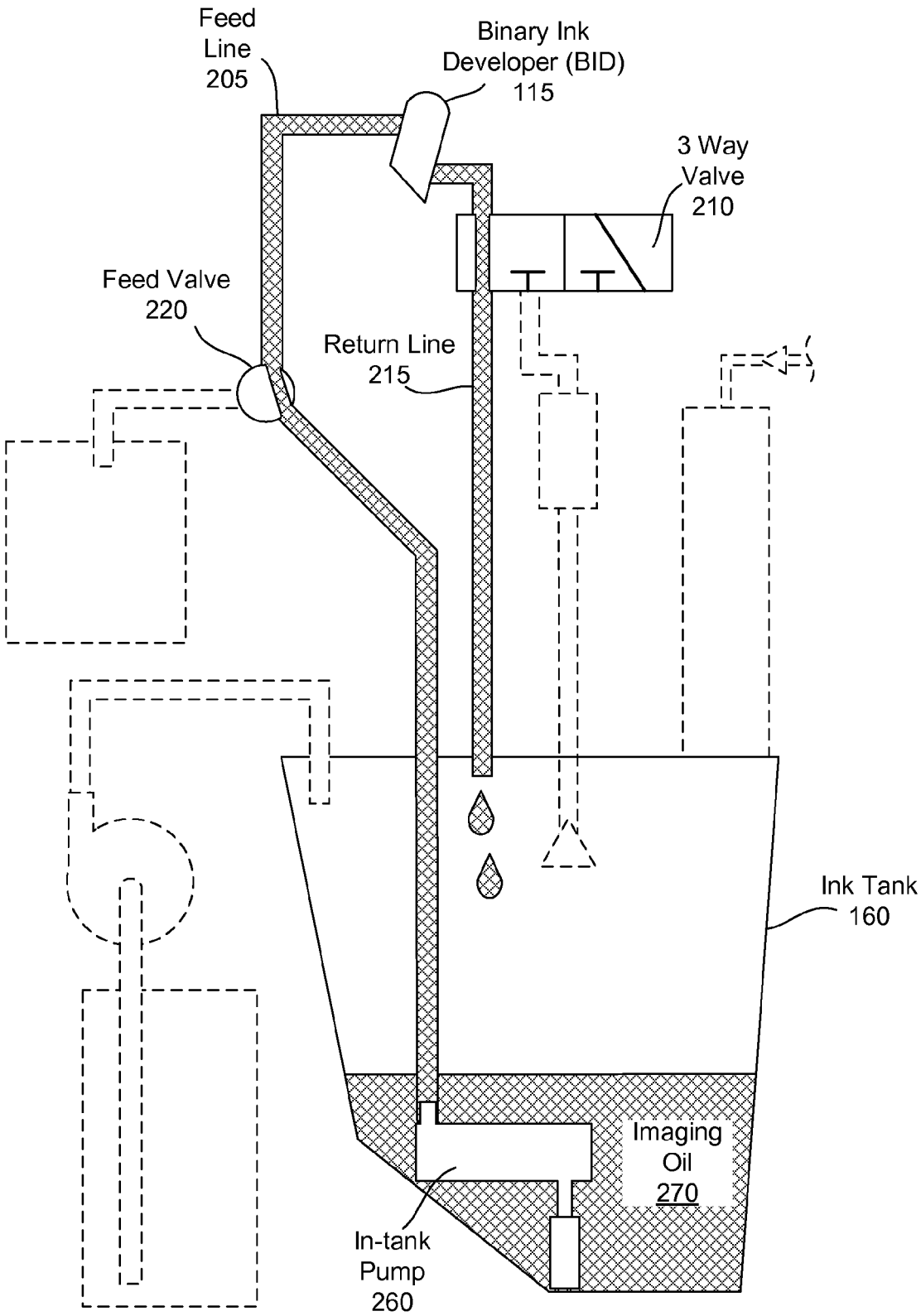
FIG. 7 is a diagram of an illustrative ink delivery system purging a return line, according to one embodiment of principles described herein.

FIG. 7 shows a fourth step in an illustrative automatic cleaning process in which the 3-way valve (210) is moved to the right to allow the filtered imaging oil (270) to purge the remainder of the 3-way valve (210) and the return line (215). The in-tank pump (260) continues to pump the imaging oil (270) through the system and the recently filtered imaging oil (270) passes through 3-way valve and return line (215) and picks up any color A contaminates which may be present and washed them into the imaging oil at the bottom of the ink tank (160). To remove these additional particulates from the imaging oil (270), the 3-way valve may be toggled back to the left and direct the flow of imaging oil through the filter (235, FIG. 6) as illustrated in FIG. 6.

At this point, the entire path through which color A ink flows has been cleaned. If a maintenance cleaning is being performed and the color of the ink is not being changed, the color A ink which has been pumped into the recycle tank (230, FIG. 4) can be pumped back into the ink tank (160) and combined with the imaging oil (270) which was used during the cleaning process. As discussed above, the imaging oil (270) is the carrier liquid within in the ink. Consequently, returning the color A ink from the recycle tank (230, FIG. 4) may make a very diluted ink. The printing system may add additional color A ink paste (242, FIG. 2) from the color A ink can (240, FIG. 2) into the ink tank (160, FIG. 2) to achieve the proper ink density and other characteristics. Thus, during maintenance cleanings, significant savings in time and ink can be obtained by utilizing an automated cleaning process. Further, because the cleaning is performed within an enclosed volume, volatile organic vapors released during the process are significantly reduced.

Figure 8:
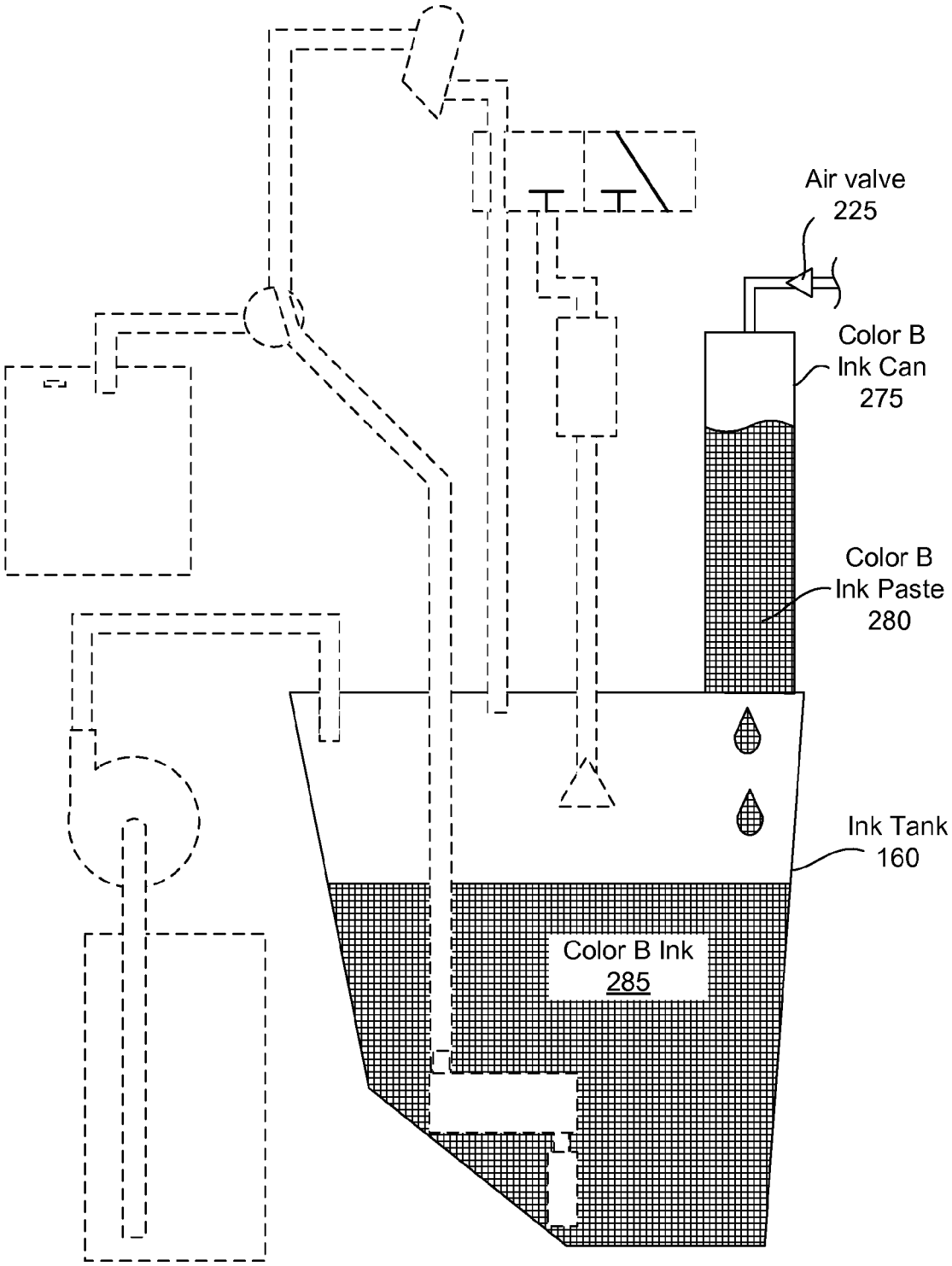
FIG. 8 is a diagram of an illustrative ink delivery system adding a concentrate of a second ink to filtered carrier liquid to form a second ink, according to one embodiment of principles described herein.

FIG. 8 shows a fifth step in an illustrative automatic cleaning process. When a color change is being performed, Color B ink solids are added to the filtered imaging oil (270, FIG. 7). According to one illustrative embodiment, the imaging oil (270, FIG. 7) has been filtered to remove the color A particulates and can be used to form the fluid carrier for the next ink. The color A ink can (240, FIG. 2) is replaced with a color B ink can (275) which contains color B ink paste (280). The air valve (225) is actuated to introduce pressurized air into the top of the color B ink can (275), which forces a metered amount of color B ink paste (280) into the ink tank (160). This color B ink paste (280) is dissolved in the image oil (270, FIG. 7) and forms color B ink (285). The color B ink (285) can then be pumped into the BID (115, FIG. 3) and used in the printing process.

Those of skill in the art will recognize that the examples described above have been presented only to illustrations and that many modifications and variations are possible in light of the above teaching.

Figure 9:
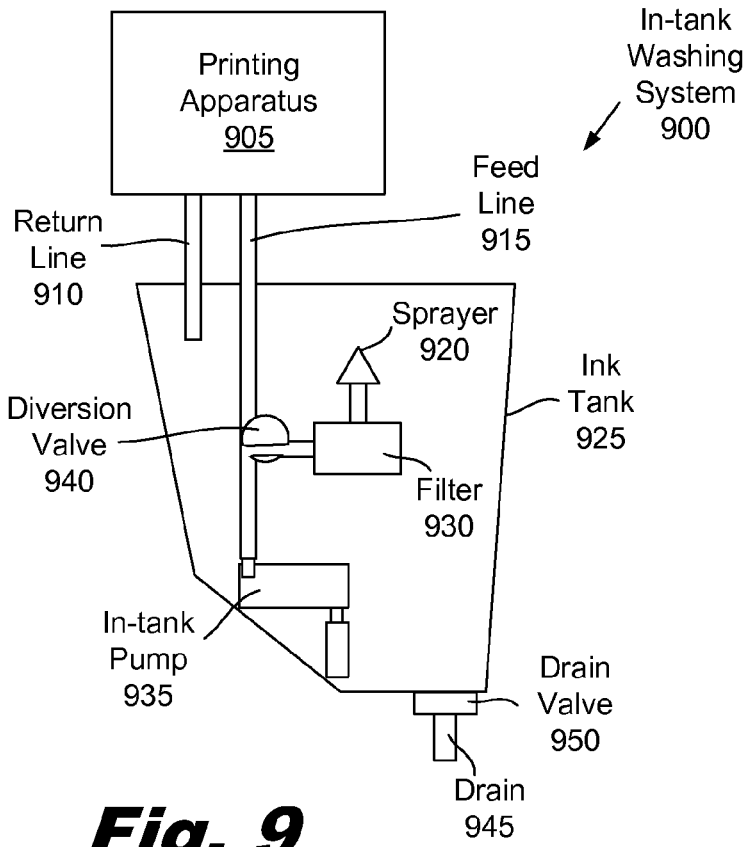
FIG. 9 is a diagram of an illustrative in-tank washing system which is configured for automatic cleaning, according to one embodiment of principles described herein.

FIG. 9 is a diagram of an illustrative automatic cleaning system which includes an in-tank washing system (900) which requires no modification of the printing apparatus (905). According to one illustrative embodiment, the system for automatic cleaning includes an ink tank (925) which has a drain (945) controlled by a drain valve (950). When the drain valve (950) is actuated, the first ink can be drained through the drain (945). As discussed above, the residuals of the first ink are left on interior surfaces of the ink tank (925). Carrier liquid is introduced into the ink tank (925). The carrier liquid is pumped by the in-tank pump (935) up the feed line (915). The diversion valve (940) redirects the pressurized carrier liquid flow into a filter (930) which removes the residuals of the first ink from the pressurized carrier liquid flow to produce a filtered carrier liquid flow. A sprayer (920) receives the filtered carrier liquid flow and sprays the filtered carrier liquid flow into the interior of the ink tank (925) such that the residuals of the first ink are carried away in the carrier liquid flow. The pump (935) continues to recirculate the carrier liquid flow through the filter (930) and the sprayer (920) until the desired cleaning is accomplished. The diversion valve (940) can be toggled back and forth to periodically divert filtered carrier liquid through the printing apparatus to flush out the residuals of the first ink. Additionally or alternatively, the diversion valve simply split the pressurized flow of carrier liquid produced by the pump (935). In this manner, the required volume and pressure of carrier liquid could be continuously supplied for the ongoing operation of the printing apparatus, while a portion of the flow could be diverted into the filter (930) and sprayer (920).

By incorporating all necessary washing components within the ink tank (925), no modification to the printing apparatus (905) is required to implement automatic cleanings. Rather, the replacement of an ink tank is all that is required to implement automatic color changes. This may be particularly advantageous in systems where the process colors are rarely, if ever, changed. However, the spot colors may be much more frequently changed. The ink tanks which supply the spot colors could be replaced with ink tanks which incorporate the in-tank washing system (900), thereby providing automatic ink color changes for the most frequently changed colors.

Figure 10:
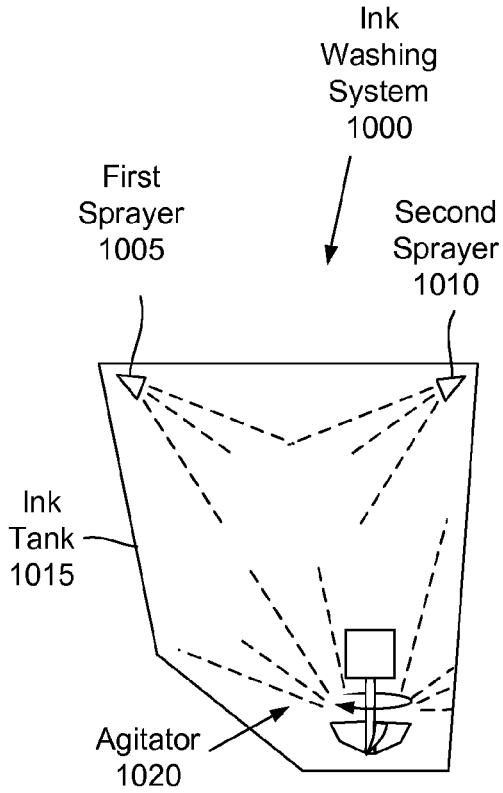
FIG. 10 is a diagram of an illustrative ink washing system which is configured for automatic cleaning, according to one embodiment of principles described herein.

FIG. 10 shows several illustrative sprayer embodiments within an ink washing system (1000). In one illustrative embodiment, multiple sprayers (1005, 1010) are positioned within the ink tank (925). These multiple sprayers (1005, 1010) provide washing action from two or more directions and may be specifically directed toward problematic areas which retain ink particulates. Additionally or alternatively, a high velocity agitator (1020) could be used as a spraying device. The agitator (1020) has one or more blades rotated by a motor. The blades are shaped such that carrier liquid from the bottom of the ink tank (1015) is thrown upward to wash the interior of the ink tank (1015).

Figure 11:
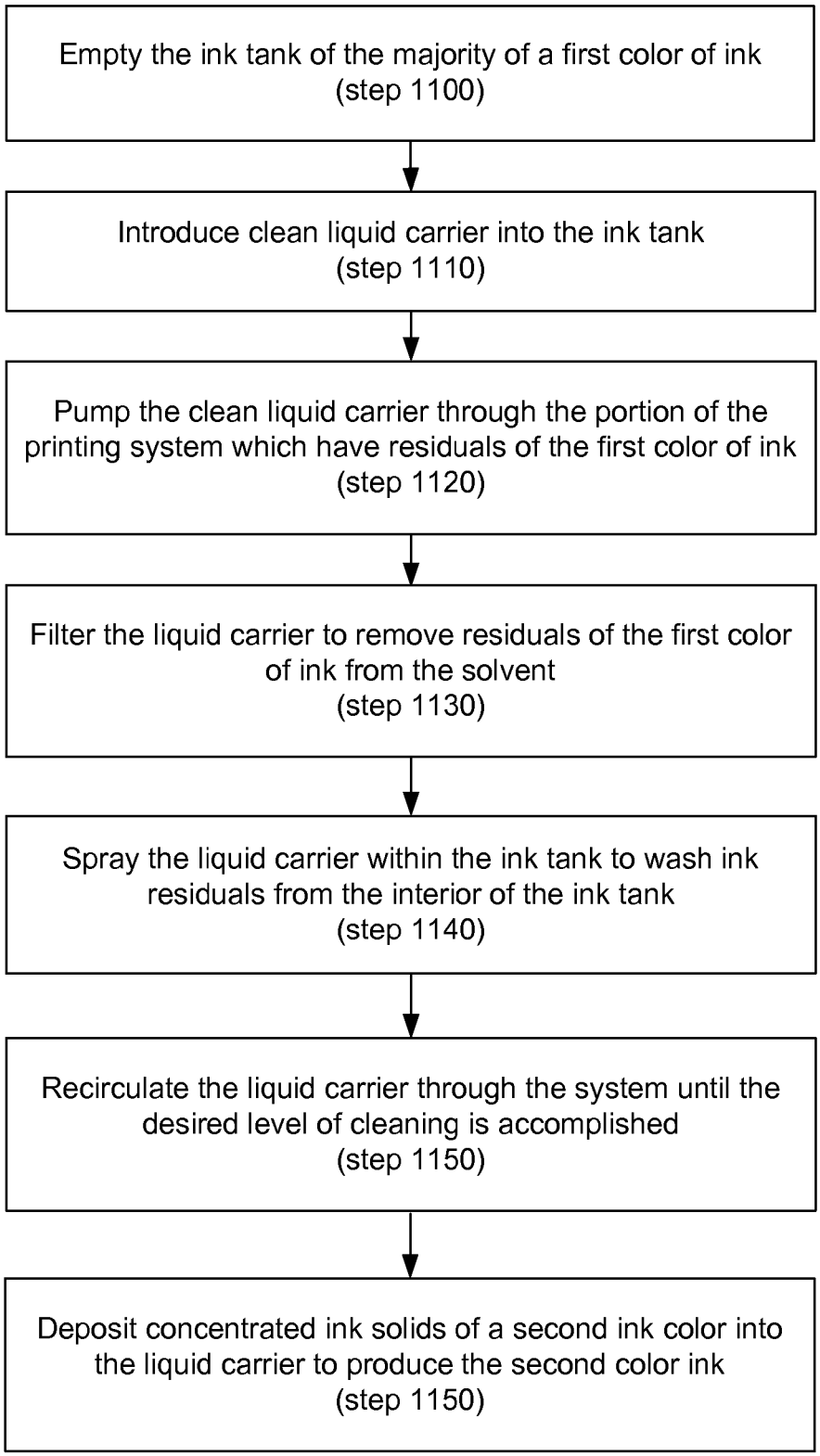
FIG. 11 is a flowchart showing an illustrative method for automatic cleaning within a printing system, according to one embodiment of principles described herein.

FIG. 11 is a flowchart which shows an illustrative method for automatic cleaning in a printing system. In a first step, the ink tank is emptied of the majority of a first color of ink (step 1100). Clean carrier liquid is then introduced into the ink tank (step 1110) and pumped through the portion of the printing system which may have residuals of the first color of ink (step 1120). The carrier liquid is then filtered to remove particulates of the first color of ink to produce a filtered carrier liquid flow (step 1130). The filtered carrier liquid flow is sprayed into the ink tank so that the residuals of the first color of ink are washed from the interior of the ink tank (step 1140). The carrier liquid collects at the bottom of the tank and is recirculated through the system until the desired cleaning is accomplished (step 1150). If a color change is being performed, solids of a second color of ink are deposited into the carrier liquid to produce a second color of ink (step 1150). Alternatively, if a maintenance cleaning is being performed, the ink from the recycle tank may be pumped back into ink tank and reconditioned for further printing.

The automatic cleaning process described above provides for an enclosed and automatic purge of a first color for maintenance cleanings or in preparation for the use of a second color within the printing system. This reduces the manual intervention by an operator. This can reduce the exposure of the operator to printing and cleaning chemicals, reduce the need for washing facilities and storage of washing fluids in the printing area, and shorten the time required to make an ink change. By automating the process, variability in color changing process can be reduced when compared to manual washing procedures. The operator training can be simplified because the operator only monitors the color change process rather than performing all of the steps manually. In some illustrative embodiments, manual intervention could be performed. For example, the fluid switches and pump operation could be manually performed if desired.

Further, the amount of volatile organic compounds released during the process is reduced because the color change process may be enclosed. No storage, manual open air handling, or disposing of additional carrier liquids is required. The ease of performing color changes facilitates the use of the on-site mixture of spot colors, thereby increasing variety and quality of prints produced.

The purging and washing process can remove virtually all of the free flowing ink solids and liquids from the ink tank and connected systems. Additionally, sludge residues can be removed from internal tank parts, including the walls, cover, electronics, pump, and tubing. This cleaning can increase the lifetime of the components and result in a reduced need for maintenance. For example, by removing sludge residues from the BID, overflows and other malfunctions can be minimized. Further, by cleaning and recycling the imaging oil, the system waste is reduced.

In some embodiments, the printing process may continue while the automatic cleaning process is ongoing. For example, if a first spot color is being switched for a second spot color, the process colors may be unaffected and can still be used. In this illustrative embodiment, the automatic cleaning of the spot color does not disrupt the operation of the printing system or delivery of process colors.

In sum, the automatic color changing system provides for more efficient changes between ink colors. Operator safety is improved and the need for operator training is reduced. Cross contamination between inks is reduced or eliminated, resulting in improved print quality. Additionally, normal printing operation can continue while the color changing process is being performed.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A system for automatic cleaning in a liquid ink printing system comprising:

an ink tank;

a pump configured to pump a carrier liquid from said ink tank as a pressurized carrier liquid flow;

a filter configured to receive said pressurized carrier liquid flow and remove particulates from said pressurized carrier liquid flow to produce a filtered carrier liquid flow;

a sprayer configured to receive said filtered carrier liquid flow and distribute said filtered carrier liquid flow throughout an interior of said ink tank to wash a first ink off of surfaces of the interior of said ink tank, said pump being configured to recirculate said filtered carrier liquid flow as a pressurized carrier liquid flow to said filter and said sprayer.

2. The system of claim 1, further comprising a feed line configured to receive said pressurized carrier fluid flow.

3. The system of claim 2, further comprising an ink developer configured to receive said pressurized carrier liquid flow from said feed line.

4. The system of claim 3, wherein excess ink from said ink developer is configured to be received by a return line that returns said excess ink to said ink tank.

5. The system of claim 4, wherein said return line bypasses said filter.

6. The system of claim 4, wherein said pump is configured to recirculate said excess ink to said ink developer.

7. The system of claim 1, further comprising a first valve having a first position and a second position, said first position being configured to direct an ink flow back into said ink tank during a printing operation and said second position being configured to direct said pressurized carrier liquid flow through said filter and said sprayer.

8. The system of claim 1, wherein said sprayer comprises multiple sprayers distributed throughout said ink tank.

9. The system of claim 1, further comprising an ink can configured to dispense a concentrate of a second ink into said carrier liquid to produce a second ink.

10. The system of claim 1, further comprising a second valve having a first position and a second position, said first position being configured to direct an ink flow to an ink developer and said second position being configured to direct said ink flow into a recycle tank.

11. The system of claim 1, in which said pump, said filter, and said sprayer are contained within said ink tank.

12. The system of claim 11, in which said ink tank comprises a replacement ink tank.

13. The system of claim 1, wherein said pump is located inside said ink tank.

14. The system of claim 1, wherein said carrier liquid comprises an imaging oil.

* * * * *